US005131100A

United States Patent [19]

Atwater et al.

[11] Patent Number: 5,131,100

[45] Date of Patent: Jul. 21, 1992

[54] ATHLETIC COMPRESSION SHORTS

[75] Inventors: William D. Atwater, Yanceyville; Mark V. Atwater, Blanch, both of N.C.

[73] Assignee: Royal Textile Mills, Inc., Yanceyville, N.C.

[21] Appl. No.: 736,711

[22] Filed: Jul. 26, 1991

[51] Int. Cl.[5] ..... A41B 9/02

[52] U.S. Cl. ..... 2/405; 2/400; 2/401; 2/403; 2/404; 66/175; 66/177; 128/159

[58] Field of Search ..... 2/78 R, 78 A, 78 B, 2/78 C, 78 D, 400, 401, 403, 404, 405; 66/171, 175, 176, 177, 178 R; 128/159

[56] References Cited

U.S. PATENT DOCUMENTS

| | | | |
|---|---|---|---|
| 563,408 | 7/1896 | Pfister . | |
| 1,637,157 | 7/1927 | Osborne, Jr. | 2/78 B |
| 2,033,505 | 3/1936 | Arons | 2/78 R |
| 2,116,822 | 5/1938 | Berger | 2/404 |
| 2,239,972 | 4/1941 | Rauser | 2/224 |
| 2,264,384 | 12/1941 | Kneibler | 2/404 X |
| 2,319,138 | 5/1943 | Kneibler | 2/405 X |
| 2,328,087 | 8/1943 | McDonald | 128/159 |
| 2,385,995 | 10/1945 | Kneibler | 2/224 |
| 2,459,043 | 1/1949 | Owenby et al. | 66/177 X |
| 2,519,534 | 8/1950 | Artzt | 66/175 |
| 2,553,353 | 5/1951 | Binder et al. | 128/159 |
| 3,006,175 | 10/1961 | Morgan | 66/177 |
| 3,083,710 | 4/1963 | Rauser | 2/404 X |
| 3,174,482 | 3/1965 | Parrott | 2/404 X |
| 3,220,410 | 11/1965 | Sloan | 128/159 |
| 3,368,563 | 2/1968 | Scheier | 66/177 X |
| 3,656,324 | 4/1972 | Jackson | 66/177 |
| 3,824,812 | 7/1974 | Matthews | 66/177 |
| 4,000,630 | 1/1977 | Imboden | 66/177 |

FOREIGN PATENT DOCUMENTS

| | | | |
|---|---|---|---|
| 473454 | 8/1949 | Canada | 2/402 |
| 1324858 | 3/1963 | France | 2/403 |
| 666434 | 2/1952 | United Kingdom | 2/404 |

*Primary Examiner*—Werner H. Schroeder
*Assistant Examiner*—Jeanette E. Chapman
*Attorney, Agent, or Firm*—Bell, Seltzer, Park & Gibson

[57] ABSTRACT

A relatively wide elastic waistband is provided to encircle the waist of the wearer and has elastic stretchability primarily in the longitudinal direction. A pair of tubular legs is provided with upper ends connected to the waistband. The upper end portions of the tubular legs are adapted to surround the opposed hips of the wearer and the lower end portions are adapted to encircle the upper thighs of the wearer and define lower leg openings surrounding the lower thighs of the wearer. A crotch panel extends throughout the medial portion and crotch of the wearer with opposite ends being connected to the medial front and rear portions of the waistband. The crotch panel is preferably formed of two panel members with the front panel member having an open mesh stitch construction while the rear panel has the usual closed stitch plain knit construction.

4 Claims, 2 Drawing Sheets

ATHLETIC COMPRESSION SHORTS

FIELD OF THE INVENTION

This invention relates generally to athletic compression shorts constructed of stretchable or elastic knit fabric, and more particularly to such shorts or tights which provide compressive support to the upper leg muscles, the abdomen, and the buttocks of the wearer without undue binding at either the crotch or the legs of the wearer.

BACKGROUND OF THE INVENTION

Various types of men's undergarments or shorts have been constructed of stretchable or elastic knit fabrics. Typical known undergarments of this type are illustrated in U.S. Pat. Nos. 2,328,087; 2,385,995; and 2,553,353. While the undergarments of this known type are constructed of stretchable or elastic knit fabric which is sewn together to form a garment adapted to cover the lower trunk and upper legs of the wearer and to provide some degree of compressive support to the wearer, they do not provide the required amount of compression for wearers engaged in certain types of exercise or strenuous bodily activities.

SUMMARY OF THE INVENTION

With the foregoing in mind, it is an object of the present invention to provide athletic compression shorts constructed of stretchable or elastic knit fabric and to provide the proper amount of compressive support to the upper leg muscles, the abdomen, and the buttocks of the wearer without excessive stretching of the garment or uncomfortable binding.

The garment of the present invention includes a relatively wide elastic waistband adapted to encircle the waist of the wearer and having elastic stretchability primarily in the longitudinal direction. A pair of tubular legs have their upper ends connected to the waistband and their upper end portions are adapted to surround the opposed hips of the wearer. The lower end portions of the tubular legs are adapted to encircle the upper thighs of the wearer and define lower leg openings adapted to surround the lower thighs of the wearer. A crotch panel of substantially uniform width has opposite ends connected to the medial front and rear portions of the waistband while the medial portion extends throughout the crotch area and between the legs of the wearer. Opposite side edges of the crotch panel are connected to the opposite side edges of the upper end portions of the tubular legs.

In a preferred embodiment, the crotch panel is formed of two different types of elastic knit fabric with an open mesh knit fabric being utilized in the front portion of the crotch panel and a plain knit, substantially closed mesh, type of fabric being provided in the rear portion of the crotch panel. The open mesh front portion of the crotch panel provides ventilation to the wearer and also provides a greater degree of stretchability and the proper amount of support in the front portion of the crotch panel.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
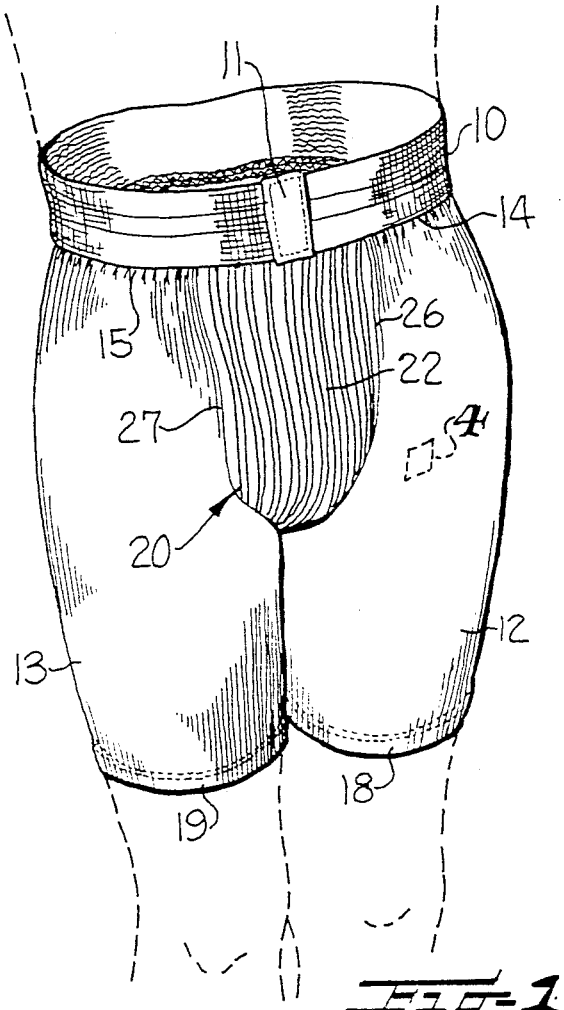
FIG. 1 is a front perspective view of the athletic compression shorts positioned on the lower trunk and upper legs of the wearer.
Figure 5:
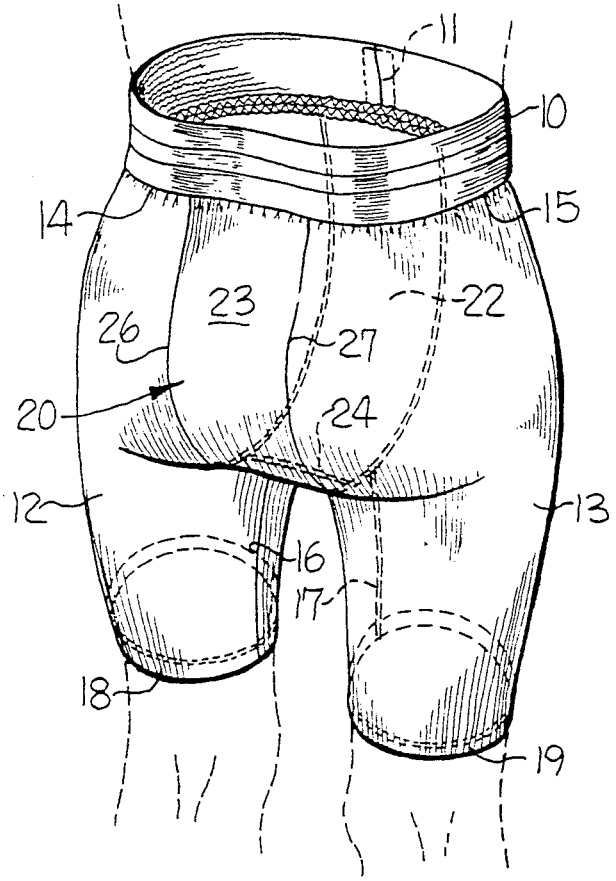
FIG. 5 is a view similar to FIG. 1 but showing a rear perspective view of the garment.

As best illustrated in FIGS. 1 and 5, the present athletic compression shorts cover the lower trunk and upper legs of the wearer and are constructed of stretchable or elastic knit fabric to provide the required amount of compressive support to the upper leg muscles, the abdomen, and the buttocks of the wearer. The athletic compression shorts include a relatively wide elastic waistband 10 surrounding the waist of the wearer. The waistband 10 is preferably on the order of about three inches wide and is preferably warp knit to provide elastic stretchability primarily in the longitudinal direction. Opposite ends of the elastic waistband are joined together, as by stitching, and a suitable label 11 is applied to the joined together ends.

Figure 2:
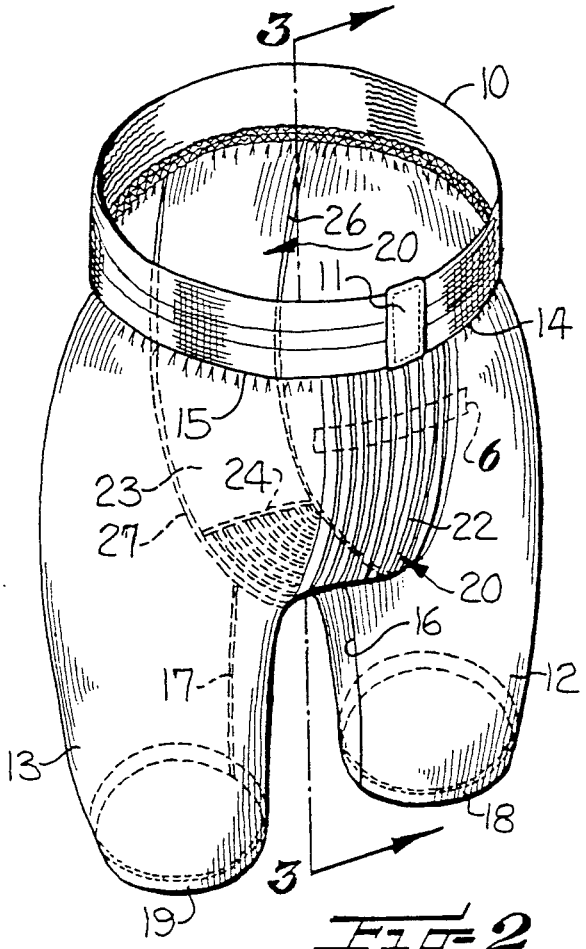
FIG. 2 is a view similar to FIG. 1 but illustrating the athletic compression shorts in expanded condition and removed from the wearer.
Figure 3:
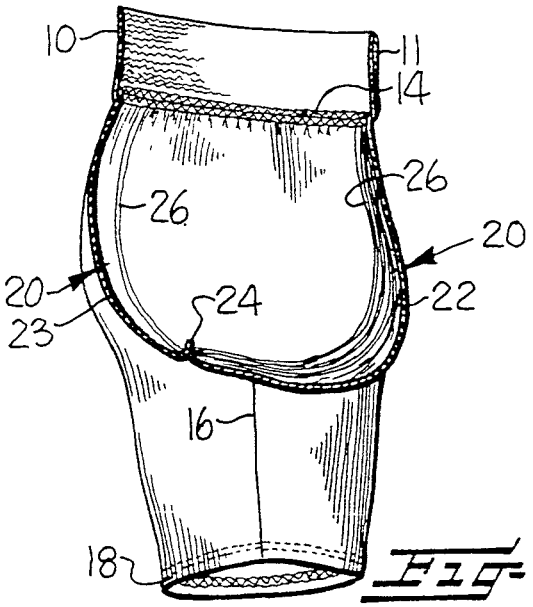
FIG. 3 is a vertical sectional view taken substantially along the line 3—3 in FIG. 2.
Figure 4:
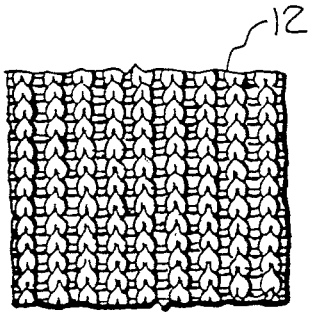
FIG. 4 is a greatly enlarged elevational view of the plain knit stretchable fabric, being taken substantially in the dotted rectangle area 4 in FIG. 1.

A pair of tubular legs 12, 13 is provided and constructed of stretchable or elastic knit fabric, preferably warp knit in a plain close knit construction with the vertical wales of plain knit stitch loops closely positioned adjacent each other, as illustrated in FIG. 4. The upper ends of the tubular legs 12, 13 are connected to the lower edge of the waistband 10, as by stitching indicated at 14, 15 respectively, and the upper end portions of the legs 12, 13 are adapted to surround the opposed hips of the wearer and have inner edges. The lower end portions of the tubular legs 12, 13 are seamed along vertical seams 16, 17 (FIG. 2) so that the lower end portions encircle the upper thighs of the wearer and define lower leg openings adapted to surround the lower thighs of the wearer. The lower leg openings are hemmed, as indicated at 18, 19.

Crotch panel means, in the form of a substantially uniform width panel of fabric, broadly indicated at 20, extends between the upper portions of the tubular legs 12, 13 with the opposite front and rear ends being connected to the medial front and rear portions of the waistband lo while the opposite side edges are connected to the inner edges of the pair of tubular legs 12, 13. As illustrated, it is preferred that the crotch panel 20 be formed of separate front and rear panel pieces 22, 23 which are seamed together, as indicated at 24, and with opposite side edges being seamed to the corresponding inner edges of the tubular legs 12, 13, as by seams 26, 27. It is preferred that the edges of the front and rear panel pieces 22, 23 be seamed, as indicated at 24, with an elastic tape so that they do not tend to pull apart or separate.

Figure 6:
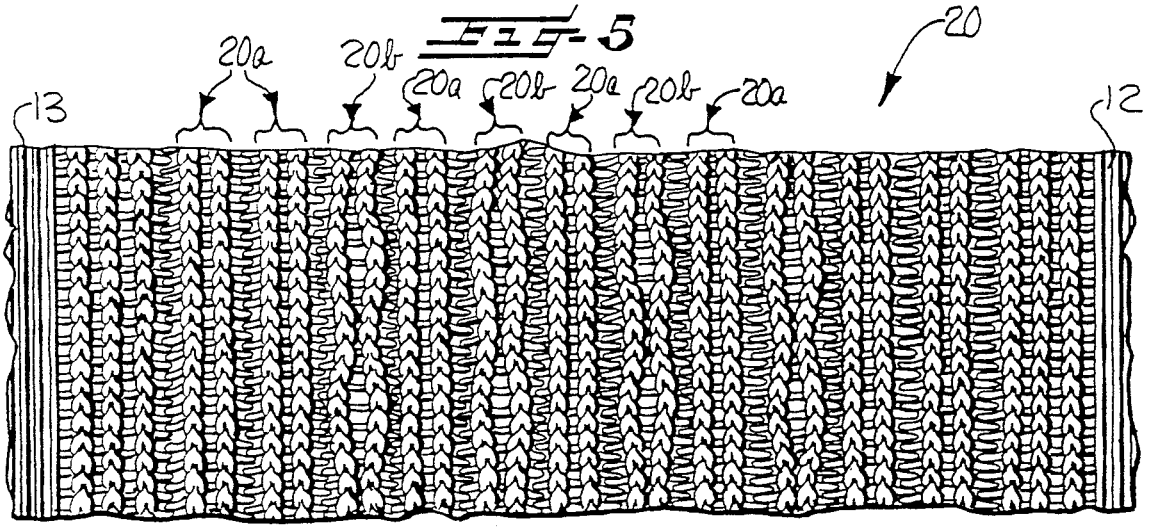
FIG. 6 is an enlarged elevational view of the open mesh knit front portion of the crotch panel, being taken substantially in the dotted rectangle 6 in FIG. 2.

It is preferred that the front panel 22 of the crotch panel 20 be warp knit with an open mesh construction where certain of the wales of stitch loops are spaced further apart than other wales, as illustrated in FIG. 6, to provide ventilation to this portion of the garment and to provide additional stretch characteristics to support the wearer in the front of the garment. Referring more specifically to FIG. 6 it will be seen that the open mesh warp knit construction has wales thereof arranged in pairs 20*a*, 20*b*, of closely space wales with the distance between adjacent pairs of wales being greater than the distance between the wales of each pair. Further, it will be noted that the pairs of wales 20*a* have the wales thereof extending in a straight walewise direction and parallel to each other. On the other hand, the other pairs of wales 20*b*, have wales thereof extending in a sinuous manner to each other. As illustrated the sinuosity of the wales of the pairs 20*b* is in a sinuous diverging and converging manner to each other. The rear panel 23 of the crotch panel 20 is preferably plain warp knit of the same construction as the tubular legs 12, 13, as illustrated in FIG. 4. It is to be understood that the crotch panel 20 could be formed of a single piece of material extending from the rear of the waistband 10, through the crotch and upwardly to the front of the waistband, if desired. Also, the garment may be provided with a pocket for supporting a protective plastic cup, if desired.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. Athletic compression shorts adapted to cover the lower trunk and upper legs of a wearer and to provide compressive support to upper leg muscles, abdomen, and buttocks of the wearer, said compression shorts comprising (a) a relatively wide elastic waistband adapted to encircle a waist of the wearer and having elastic stretchability primarily in a longitudinal direction, (b) a pair of tubular legs formed of stretchable elastic knit fabric and including upper ends connected to said waistband, upper end portions adapted to encircle opposed hips of the wearer, and lower end portions adapted to encircle upper thighs of the wearer and defining lower leg openings adapted to surround lower thighs of the wearer, and (c) crotch panel means formed of stretchable elastic knit fabric and including opposite ends connected to medial front and rear portions of said waistband, and a medial portion extending throughout a crotch area and between legs of the wearer, opposite side edges of said crotch panel means being connected to said upper end portions of said pair of tubular legs and wherein said crotch panel means comprises a front panel and a rear panel joined to said front panel in the crotch area, and wherein said rear panel is of a plain warp knit construction and said front panel is of an open mesh warp knit construction wherein the wales thereof are arranged in pairs of closely spaced wales with the distance between adjacent pairs of wales being greater than the distance between the wales of each pair, and wherein certain pairs of wales have the wales thereof extending in a straight walewise direction and parallel to each other, and wherein other pairs of wales have the wales thereof extending in a sinuous manner to each other.

2. Athletic compression shorts according to claim 1 wherein said sinuously extending wales of said other pairs of wales extend in a sinuous diverging and converging manner to each other.

3. Athletic compression shorts adapted to cover the lower trunk and upper legs of a wearer and to provide compressive support to upper leg muscles, abdomen, and buttocks of the wearer, said compression shorts comprising (a) a relatively wide elastic waistband adapted to encircle a waist of the wearer and having elastic stretchability primarily in a longitudinal direction, (b) a pair of tubular legs including upper ends connected to said waistband, upper end portions adapted to encircle opposed hips of the wearer, and lower end portions adapted to encircle upper thighs of the wearer and defining lower leg openings adapted to surround lower thighs of the wearer, and (c) crotch panel means including opposite ends connected to medial front and rear portions of said waistband, and a medial portion extending throughout a crotch area and between legs of the wearer, opposite side edges of said crotch panel means being connected to said upper end portions of said pair of tubular legs and wherein said crotch panel means comprises a front panel and a rear panel joined to said front panel in the crotch area, and wherein said rear panel is of a plain warp knit construction and said front panel is of an open mesh warp knit construction wherein the wales thereof are arranged in pairs of closely spaced wales with the distance between adjacent pairs of wales being greater than the distance between the wales of each pair, and wherein certain pairs of wales have the wales thereof extending in a straight walewise direction and parallel to each other, and wherein other pairs of wales extend in a diverging and converging manner to each other.

4. Athletic compression shorts according to claim 3 wherein said sinuously extending wales of said other pairs of wales extend in a sinuous diverging and converging manner to each other.

* * * * *

UNITED STATES PATENT AND TRADEMARK OFFICE

CERTIFICATE OF CORRECTION

PATENT NO. : 5,131,100

DATED : July 21, 1992

INVENTOR(S) : William D. Atwater et al.

It is certified that error appears in the above-identified patent and that said Letters Patent is hereby corrected as shown below:

Column 2, line 55, delete "1o" and substitute therefor --10--.

Column 3, line 7, delete "space" and substitute therefor --spaced--.

Column 4, line 19, delete "to upper" and substitute therefor --to a upper--.

Column 4, line 23, delete "a waist" and substitute therefor --the waist--.

Signed and Sealed this

Twenty-sixth Day of October, 1993

*Attest:*

Bruce Lehman

BRUCE LEHMAN

*Attesting Officer*

*Commissioner of Patents and Trademarks*